United States Patent [19]

Horlitz, Jr.

[11] 3,956,898

[45] May 18, 1976

[54] MARINE VAPOR GENERATOR HAVING LOW TEMPERATURE REHEATER

[75] Inventor: Carl Frederick Horlitz, Jr., Bloomfield, Conn.

[73] Assignee: Combustion Engineering, Inc., Windsor, Conn.

[22] Filed: Dec. 20, 1974

[21] Appl. No.: 535,007

[52] U.S. Cl. ..... 60/676; 60/698; 60/716; 122/448 B; 122/485

[51] Int. Cl.[2] ..... F22B 37/06; F01K 19/00

[58] Field of Search ..... 60/676, 698, 716–718, 60/679; 122/484, 485, 448 B

[56] References Cited

UNITED STATES PATENTS

| | | | |
|---|---|---|---|
| 2,867,983 | 1/1959 | Armacost | 60/676 X |
| 3,016,712 | 1/1962 | Taylor | 60/676 |
| 3,283,506 | 11/1966 | Hutchison et al. | 60/676 X |

*Primary Examiner*—Allen M. Ostrager
*Attorney, Agent, or Firm*—Robert L. Olson

[57] ABSTRACT

A vapor generator organization arranged for operation in a marine reheat power plant is described in which the reheater tube bundle is disposed in the rear gas pass section of the unit where it is subjected only to low temperature combustion gas during periods of ship maneuvering when no vapor flow occurs through the reheater tubes. A separately fired burner arrangement is operably disposed in the rear gas pass and adapted to be fired at times when the reheater is operative in the system.

13 Claims, 4 Drawing Figures

MARINE VAPOR GENERATOR HAVING LOW TEMPERATURE REHEATER

BACKGROUND OF THE INVENTION

The invention relates to marine power plant systems including separate turbines arranged for ahead or astern operation and wherein the ahead turbine operates on a reheat vapor cycle.

Problems arise with the application of the reheat cycle to marine power plants due to the fact that separate turbines are required to operate a vessel in the ahead and in the astern directions. The need for separate turbines to operate the vessel in each direction creates much difficulty and in most cases even prevents the use of a reheater due to the fact that when steam flows to the astern turbine vapor supplied to the ahead turbine must be discontinued and this in turn means that vapor flow to the reheater is also discontinued thereby starving the reheater tubes of cooling fluid. With no cooling fluid flowing through the reheater at these times the tubes are subject to deterioration by burnout.

It has been the practice in marine power plant installations operating on a reheat cycle to protect the heat exchange tubes that comprise the reheater tube bundle against overheating and burnout during periods of astern maneuvering in one of two principal ways. First, the reheater tubes have been cooled by passing an amount of superheated vapor through them during these periods wherein the heat picked-up in the tubes is transferred via the vapor to an external heat exchanger or to a spray desuperheater. This manner of reheater tube protection has gained little acceptance due to the fact that a complex, expensive valve and piping arrangement is required to reroute the superheated vapor flow during periods of non-reheat operation.

Alternatively, protection schemes have involved isolation of the reheater tube bundle wherein the same is physically removed from the main section of the vapor generator. In these arrangements the reheater is housed in a separate chamber, normally formed by division walls in the furnace, and heated during periods of operation by independent, supplemental burners. Such schemes are not totally acceptable due in part to the fact that, since only a portion of the total combustion gas is caused to flow to the reheater, inordinately high gas temperatures are normally employed including a significant amount of radiant heat input because of the close proximity of the burners to the tube bundle. This high heat input requires the tube bundle to be designed with an undesirably high pressure drop which has an adverse affect on cycle efficiency. Or, if pressure drops are kept low, then poor vapor distribution is a potential hazard giving rise to the danger of tube failure.

It is to the improvement of such marine power plant systems, therefore, that the present invention is directed.

SUMMARY OF THE INVENTION

According to the present invention there is provided in a marine power plant installation including a multistage ahead turbine, an astern turbine, a vapor generator including an evaporator section having an upper drum, a lower drum, a bank of evaporator tubes interconnecting said drums, a superheater, a reheater, burner means for generating combustion gases to supply heat to said vapor generator and means for selectively supplying superheated and reheated vapor to said ahead turbine and only superheated vapor to said astern turbine, the improvement comprising said reheater being disposed downstream in the combustion gas sense from said tube bank and said superheater and there further being provided supplemental burner means operative when reheated vapor is supplied to said ahead turbine.

The invention has for a principal object the provision of a vapor generator utilized in a marine power plant installation operating on a reheat vapor cycle in which the tubes of the reheater tube bundle are effectively protected during astern maneuvering of the ship when no vapor is passed through the reheater.

Another object of the invention is to provide a vapor generator of the described type in which the reheater tube bundle is housed in a section of the unit that conducts only gases at a low temperature during periods of non-reheat operation and wherein means are provided to impart high temperature gases to the reheater for reheat operation of the plant.

Still another object of the invention is to provide a vapor generator of the described type in which the tubes that comprise the reheater tube bundle are protected against the effects of radiant heating during periods of either reheat or non-reheat operation of the plant.

For a better understanding of the invention, its operating advantages and the specific objectives obtained by its use, reference should be made to the accompanying drawings and description which relate to a preferred embodiment thereof.

DESCRIPTION OF THE PREFERRED EMBODIMENT

Figure 1:
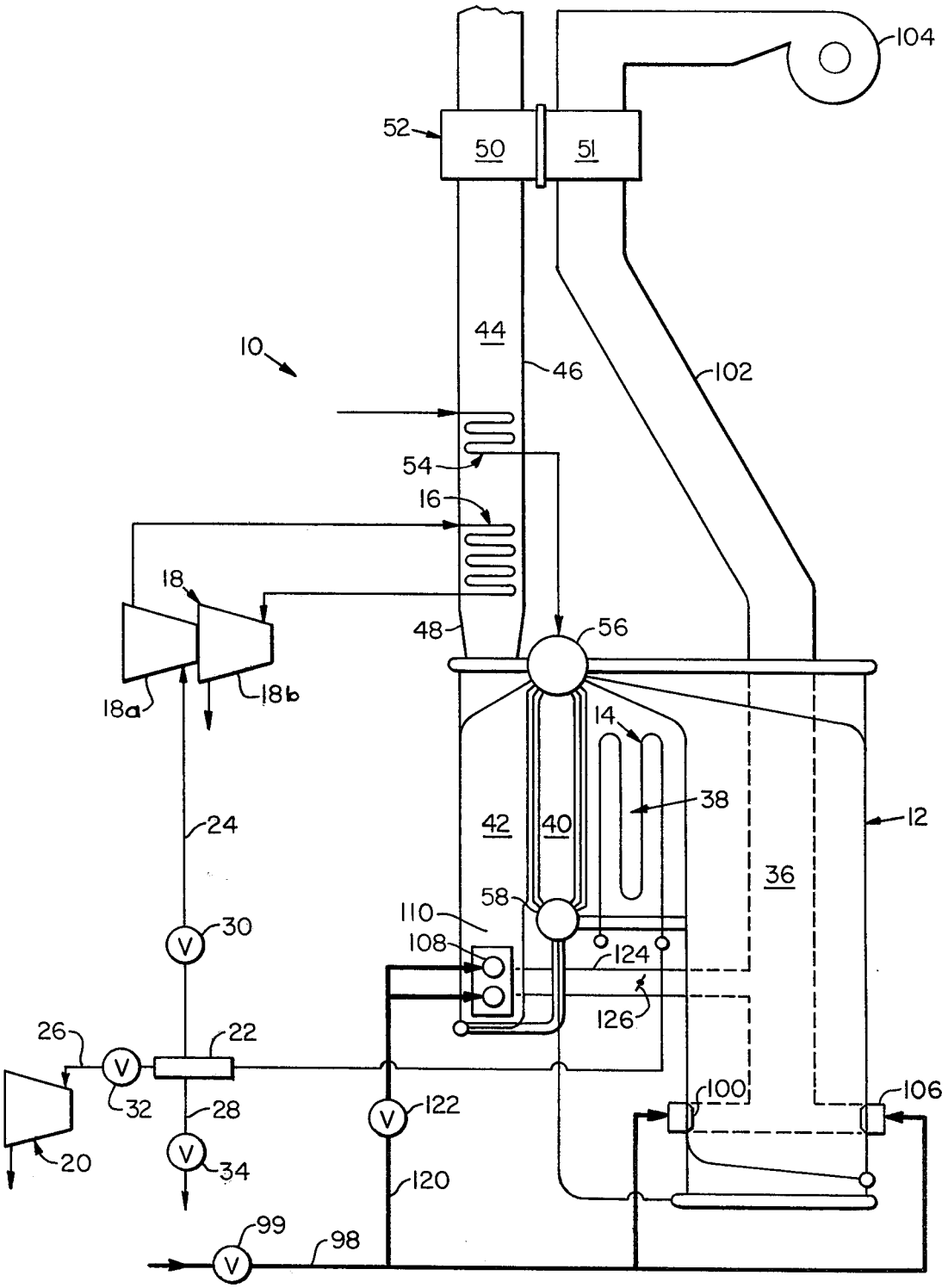
FIG. 1 is a schematic representation of a marine power plant equipped with a vapor generator constructed in accordance with the present invention.

Referring now to FIG. 1 of the drawing, there is shown a schematic representation of a marine power plant installation 10 adapted to operate on a reheat vapor cycle in accordance with the teachings of the present invention. The installation 10 comprises a vapor generator 12 including a superheater 14 and a reheater 16 adapted to supply high temperature vapor to an ahead turbine 18 consisting of separate high and low pressure stages, 18*a* and 18*b* respectively, and an astern turbine 20. The ahead and astern turbines 18 and 20 are connected in parallel to the superheater 14 of the vapor generator 12 through a high temperature vapor manifold 22 from which lines 24, 26 and 28 extend bearing valves 30, 32 and 34 respectively.

The system is intended to operate as follows. When it is desired to propel the vessel in the forward direction, the ahead turbine 18 is placed in service by opening the valve 30 and closing valve 32. High pressure, high temperature vapor is then supplied by the vapor generator 12, passing from the outlet of the superheater 14 to the inlet of the high pressure stage 18*a* of turbine 18 where it is expanded to a lower pressure and temperature in driving the turbine and its connected propulsion unit (not shown). The vapor exhausted from the high pressure stage 18*a* is then returned to the vapor generator 12 where it is heated to an elevated temperature in flowing through the reheater 16 prior to being passed to the low pressure stage 18*b* from whence it is discharged to a condenser (not shown).

When it is desired to operate the vessel rearwardly, vapor flow to the ahead turbine 18 is terminated by closing the valve 30. The valve 32 is then opened and high pressure, high temperature vapor is passed from the outlet of the superheater 14 to the astern turbine 20 where it drives the turbine and the connected astern propulsion unit (not shown) before being passed directly to the condenser.

Figure 2:
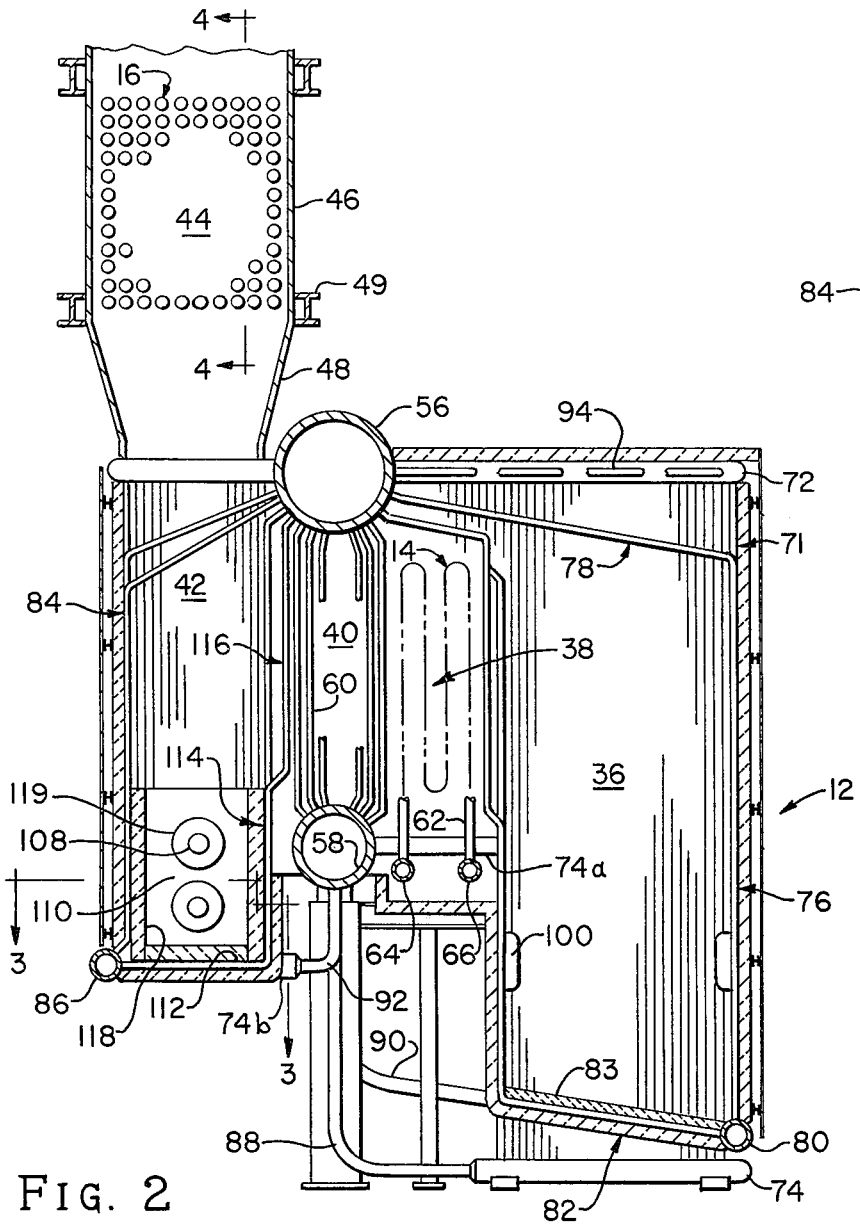
FIG. 2 is an elevational side section of the vapor generator according to the invention.
Figure 3:
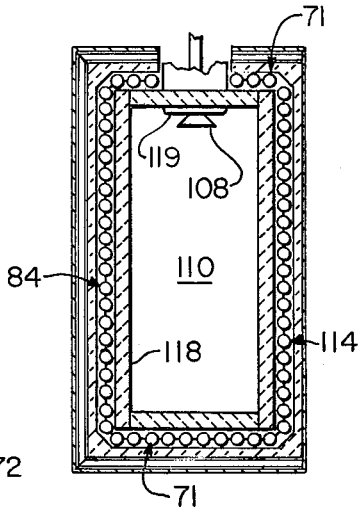
FIG. 3 is a sectional elevation taken along line 3—3 of FIG. 2.
Figure 4:
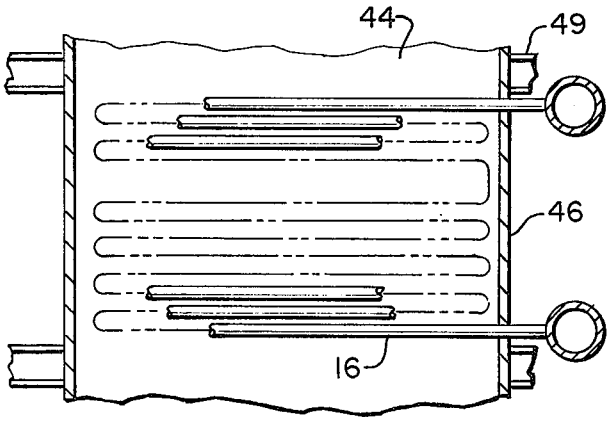
FIG. 4 is a plan sectional view taken along line 4—4 of FIG. 2.

The vapor generator 12, as shown in greater detail in FIG. 2, is a bottom-supported unit having tube-lined walls defining a generally rectangular setting or enclosure including furnace chamber 36, superheat section 38, boiler section 40 and the lower portion 42 of a rear gas pass, all of which are disposed in open, side-by-side gas communication. The upper portion 44 of the rear gas pass is formed by an upstanding duct 46 which connects with the lower portion of the rear gas pass 42 through a transition member 48. The duct 46 which is lined with insulating material and supported from independent structural members, is adapted to conduct combustion gases generated in the furnace chamber 36 through the gas side 50 of air heater 52 to a stack (not shown) and contains the reheater 16 and an economizer 54 disposed at longitudinally spaced positions along its length.

The boiler section 40 of the vapor generator 12 is defined by vertically spaced, parallel upper and lower drums, 56 and 58 respectively, that extend transversely of the setting. The drums are interconnected in fluid circulation by a bank of boiler tubes 60 that are disposed in plural rows in laterally spaced relation across the width of the unit. The upper drum 56, as is well known, may contain conventional separating apparatus (not shown) for separating the vapor-liquid mixture deposited therein into its component parts. The lower drum 58 serves as a manifold for receiving the liquid component of the mixture and dispersing it to the various parts of the fluid circuit.

The superheat section 38 contains the superheater 14 which comprises a bundle of serpentine tubes 62 disposed in laterally spaced relation across the width of the setting. The tubes 62 are connected in parallel flow relation by inlet and outlet headers, 64 and 66 respectively, that underlie the tube bundle and extend transversely of the setting in subtending relation thereto.

The tubes that line the peripheral walls of the vapor generator 12 are preferably formed as welded panels, as is well known in the art, to render the enclosure substantially gas tight. The enclosure may further be covered by insulating material 68 and enclosed by an outer casing 70. The oppositely spaced side walls 71 (only one of which appears in FIG. 2) extend the length of the unit and comprise a plurality of upstanding tubes that connect at their opposite ends with upper and lower headers 72 and 74 respectively. The front wall 76 and roof 78 over the furnace chamber 36 and superheat section 38 are formed by panels of tubes that connect at their lower ends with lower front wall header 80 and at their upper ends with the upper drum 56. The furnace floor 82 is lined with tubes that connect with header 80 at their lower ends. These tubes are offset as shown to extend vertically between the furnace chamber 36 and superheat section 38 thereby to form screen tubes to protect the superheated tube bundle against the radiant effects of combustion that occur within the furnace chamber. At their upper ends the screen tubes are laterally offset to overlie the superheater bundle 14 and communicate with the upper drum 56. A layer of refractory insulation 83 overlies the floor tubes to protect them against slag formation thereon.

The rear wall 84 of the unit contains tubes that extend from a lower rear wall header 86 vertically upwardly to a point adjacent the upper end of the lower portion 42 of the rear gas pass where alternate tubes are laterally offset at each of two vertically spaced locations across the gas pass with their upper ends connecting with the upper drum 56. In this way spaces are provided between the tubes to permit the flow of combustion gases through the rear gas pass.

Circulation of vaporizable fluid through the vapor generator 12 is naturally induced with supply lines 88, 90 and 92 extending from the lower drum 58 to supply the fluid in liquid form therefrom to the lower side wall header 74 and lower front wall header 80. The lower side wall header 74*a* adjacent the superheater section 38 receives liquid directly from the drum 58, it being connected at one end directly in communication with the drum. The vapor-liquid mixture produced in the tubes lining the side walls 71 is discharged from the upper side wall headers 72 by means of vapor relief tubes 94 that connect between the headers and the upper drum, except in the case of the rearwardmost header 72*a* in each side wall which connects at one end directly with the drum.

Fuel for combustion within the furnace chamber 36 is supplied via fuel line 98 (FIG. 1) containing supply valve 99 to burners (not shown) that extend through openings 100 disposed at the corners of the walls forming the lower region of the furnace chamber. Combustion air is supplied to the burners through an air duct 102. Air flow through the duct 102 is effected by fan 104 with the flow passing through the air side 51 of the air heater 52 to wind boxes 106 that enclose the burners. The gases produced in the furnace chamber 36 are caused to flow from the chamber seriatim through the superheater section 38, boiler section 40 and exiting the unit through the lower and upper portions, 42 and 44 respectively, of the rear gas pass.

According to the present invention supplemental burners 108 are provided to augment the flow of combustion gases through the rear gas pass to the reheater 16. These burners are operably disposed in a burner compartment 110 located at the bottom end of the rear gas pass. The compartment 110 defines a subtending extension of the gas pass region of the unit and is formed on its rear side by the lower ends of the rear wall tubes that emanate from lower rear wall header 86. The opposite sides of the compartment 110 are similarly formed by the lower ends of the tubes that connect with lower side wall headers 74. The floor 112 and front wall 114 of the compartment 110 are formed by tubes that connect at one end to the header 86 and at their opposite ends to the upper drum 56. As shown best in FIG. 2 these tubes are disposed in adjacent, side-by-side relation in forming the floor 112 and front wall 114 of the burner compartment; however, adjacent the rear end of the boiler section 40 alternate tubes are laterally offset to define an opening 116 which extends substantially the full height of the boiler bank in order to permit flow of combustion gases from the furnace chamber 36 to the rear gas pass. The surface of the tubes forming burner compartment 110 is covered with a layer of refractory material 118 in order to protect the same against the radiant effects of combustion that occurs in the compartment. Openings 119 in the refractory wall accommodate passage of the supplemental burners 108.

Fuel supplied to the supplemental burners 108 is passed through fuel line 120 off the main fuel line 98. An operating valve 122 in line 120 permits the burners to be fired independently of the main burners that operate in the combustion chamber 36. Combustion air for the supplemental burners is supplied through duct 124 containing control damper 126 that connects between a burner wind box (not shown) and the air duct 102.

Operation of the herein described vapor generator organization is as follows. During ahead and astern operation of the vessel's power plant fuel and air are admitted to the main burners for combustion in the furnace chamber 36 by opening valve 99 in fuel line 98 and by initiating operation of the fan 104. Simultaneously therewith vaporizable liquid is admitted to the system through line 128 to the economizer 54. The combustion gases generated in the furnace chamber 36 are passed in series from the furnace chamber 36 through the superheat section 38, the boiler section 40 and exiting the vapor generator 12 from the lower portion 42 of the rear gas pass through outlet duct 46 which forms its upper portion 44. The combustion gases heat the vaporizable fluid flowing in the fluid circuits of the vapor generator to evaporate the same whereby a mixture of vapor and liquid is collected in the upper drum 56 and processed therein with the vapor component being passed to the superheater 14 and thence selectively to the ahead or astern turbines, 18 or 20 respectively, through manifold 22 by operation of the appropriate valves 30 or 32.

If operation of the ahead turbine 18 is desired the supplemental burners 108 in compartment 110 are fired by opening valve 122 in line 120 and damper 126 in duct 124. The combustion gases generated in the burner compartment 110 mix with the gases from the furnace chamber 36 to augment the amount of heat passed in heat exchange relation with the reheater 16 such that the ahead turbine stages **18*a* and 18*b*** can effectively operate on a reheat vapor cycle.

During periods of astern operation of the plant, valve 30 in line 24 is closed and valve 32 in line 26 opened. With the plant in this condition, vapor flow through the tubes of the reheater 16 ceases. Therefore, according to the invention, simultaneously with the termination of vapor flow to the reheater 16, valve 122 and damper 126 are closed whereby operation of the supplemental burners 108 in compartment 110 stops. Thus, the combustion gases entering the rear gas pass are solely the gases emanating from the furnace chamber 36 whose heat content has been spent in heating fluid flowing through the circuits of the vapor generator 12 thereby rendering the temperature at a level well below that which is harmful to the tube metal in the reheater 16.

It will be appreciated that, by means of the present invention, there is provided a vapor generator organization for use in a marine reheat power plant installation in which simple, inexpensive means are provided for effectively protecting the tubes of the reheater tube bundle against overheating and possible failure when the installation is operated in a non-reheat mode. By disposing the reheater tube bundle in a normally low gas temperature region of the vapor generator the tube metal will not be subjected to gas temperatures beyond those that can be readily tolerated when no vapor flows through them. At the same time, the provision of a supplemental source of combustion energy to provide adequate heat during periods of reheat operation enables the tube bundle to be constructed of a size to keep its cost within economic bounds.

Moreover, additional thermal protection is afforded the reheater tubing in the described arrangement by the fact that the reheater is disposed in a location remote from the compartment housing the supplemental burners and on the opposite side of the opening through which combustion gases from the furnace chamber enter the rear gas pass. By reason of this feature the reheater tubing is protected by the flow of combustion gas from the furnace chamber against the radiant effects of the combustion that occurs in the burner compartment during operation of the supplemental burners.

It will be understood that various changes in the details, materials and arrangements of parts which have been herein described and illustrated in order to explain the nature of the invention, may be made by those skilled in the art within the principal and scope of the invention as expressed in the appended claims.

What is claimed is:

1. In a marine power plant installation including a multi-stage ahead turbine, an astern turbine, a vapor generator including an evaporator section having an upper drum, a lower drum, a bank of evaporator tubes interconnecting said drums, a superheater, a reheater, burner means for generating combustion gases to supply heat to said vapor generator and means for selectively supplying superheated and reheated vapor to said ahead turbine and only superheated vapor to said astern turbine, the improvement comprising said reheater being disposed downstream in the combustion gas flow sense from said tube bank and said superheater, and supplemental burner means operative when reheated vapor is supplied to said ahead turbine.

2. The improvement recited in claim 1 in which said vapor generator includes a rear gas pass for receiving combustion gases downstream of said tube bank and said superheater, wherein said reheater is disposed in said rear gas pass and including supplemental burner means operatively disposed for supplying combustion gases to said rear gas pass.

3. The improvement recited in claim 2 in which said vapor generator includes a burner compartment separate from but opening into said rear gas pass and said supplemental burner means operatively disposed in said burner compartment.

4. The improvement as recited in claim 3 in which said rear gas pass includes means forming a first opening for reception of combustion gases from said burner means, and means forming a second opening for reception of combustion gases from said burner compartment and wherein said reheater is disposed oppositely said first opening from said second opening.

5. In a marine power plant installation wherein superheated and reheated vapor is selectively supplied to an ahead turbine and only superheated vapor is supplied to an astern turbine, a vapor generator for supplying vapor to said turbines comprising:

a. a furnace chamber, a superheater and an evaporator section disposed in side-by-side relation;
b. burner means operatively disposed in said furnace chamber for producing combustion gases therein;
c. means for passing said combustion gases seriatim through said superheater and said evaporator section;
d. a rear gas pass communicating with said evaporator section for conducting combustion gases therefrom;
e. means forming a reheater disposed in said rear gas pass in heat transfer relation to the gases flowing therethrough; and
f. supplemental burner means independently operable in said rear gas pass for supplying supplemental combustion gas thereto when vapor is supplied to said ahead turbine.

6. A marine power plant installation as recited in claim 5 in which combustion gases from said burner means and said supplemental burner means are mixed in said rear gas pass downstream of said reheater.

7. A marine power plant installation as recited in claim 6 in which said vapor generator includes a burner compartment separate from but communicating with said rear gas pass and means for mounting said supplemental burner means for operation in said burner compartment.

8. A marine power plant installation as recited in claim 7 in which said reheater is disposed in said rear gas pass at a location opposite the point of communication of said evaporator section from the point of communication of said burner compartment.

9. A vapor generator for operation in a marine power plant installation wherein superheated and reheated vapor is selectively supplied to an ahead turbine and only superheated vapor is supplied to an astern turbine, said vapor generator comprising:

a. rectangularly arranged tubular walls defining a gas enclosure including a furnace chamber, a superheater chamber and a boiler section disposed in open, side-by-side relation;
b. burner means operatively disposed in said furnace chamber for producing combustion gases therein;
c. means for passing said combustion gases seriatim through said superheater chamber and said boiler bank;
d. a vertically extending rear gas pass;
e. an opening in said rear gas pass connecting the same in fluid communication with said boiler section;
f. a reheater disposed in said rear gas pass downstream in the gas flow sense from said opening; and
g. supplemental burner means independently operable in said rear gas pass.

10. A vapor generator as recited in claim 9 including a burner compartment containing said supplemental burner means separate from but communicating with said rear gas pass.

11. A vapor generator as recited in claim 10 in which said reheater comprises a tube bundle disposed vertically above said opening.

12. A vapor generator as recited in claim 11 in which said burner compartment includes an opening communicating with said rear gas pass at the bottom thereof.

13. A vapor generator as recited in claim 12 in which said burner compartment comprises a subtending extension of said rear gas pass.

* * * * *